US006718660B2

(12) United States Patent
Rivard

(10) Patent No.: US 6,718,660 B2
(45) Date of Patent: Apr. 13, 2004

(54) MOTORIZED ROAD-GOING VEHICLE FOR MAKING TRENCHES IN THE GROUND

(75) Inventor: Daniel Rivard, Daumeray (FR)

(73) Assignee: S.D.T.O., Durtal (FR)

( * ) Notice: Subject to any disclaimer, the term of this patent is extended or adjusted under 35 U.S.C. 154(b) by 151 days.

(21) Appl. No.: 10/046,301

(22) Filed: Jan. 16, 2002

(65) Prior Publication Data

US 2002/0139014 A1 Oct. 3, 2002

(30) Foreign Application Priority Data

Mar. 29, 2001 (FR) ..... 01 04254

(51) Int. Cl.[7] ..... E02F 5/08; E21C 35/18

(52) U.S. Cl. ..... 37/347; 405/128.15; 299/39.8

(58) Field of Search ..... 37/355, 347; 172/540, 172/554; 111/118; 405/128.1, 128.2, 128.25, 128.15; 299/39.2, 39.8, 39.5; 404/92, 76

(56) References Cited

U.S. PATENT DOCUMENTS 4,193,217 A 3/1980 Poche
4,262,966 A * 4/1981 Bouplon ..... 299/39.8
4,909,575 A * 3/1990 Lupton ..... 299/39.5
5,765,966 A 6/1998 White et al.
6,543,963 B2 * 4/2003 Bruso ..... 405/128.15

FOREIGN PATENT DOCUMENTS

| | | |
|---|---|---|
| DE | 3710283 | 10/1988 |
| EP | 0368129 | 5/1990 |
| EP | 1013834 | 6/2000 |
| FR | 2584435 | 1/1987 |
| FR | 2749866 | 12/1997 |
| FR | 2789414 | 8/2000 |

* cited by examiner

*Primary Examiner*—Robert E. Pezzuto
(74) *Attorney, Agent, or Firm*—Stevens, Davis, Miller & Mosher, LLP

(57) ABSTRACT

A motorized road-going vehicle for making trenches may include on its chassis a device for digging a trench using a trenching wheel and a device for sucking and collecting the spoil produced while the trench is being dug. The trenching wheel is mounted so that it can pivot about an axis orthogonal to the chassis so as to occupy a working position projecting from the chassis and a transport position brought up onto the chassis.

10 Claims, 5 Drawing Sheets

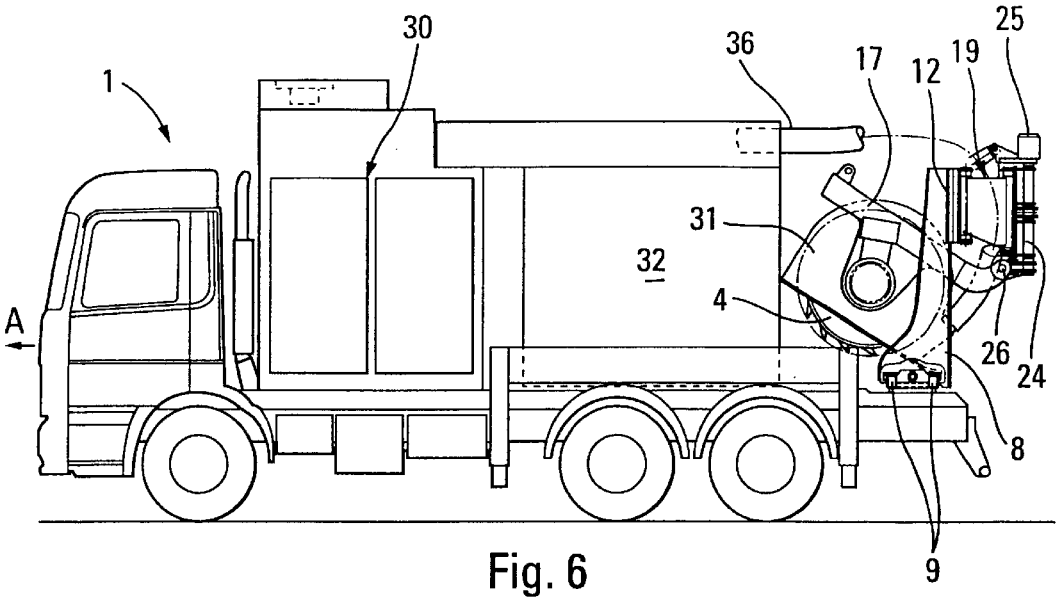
Fig. 6
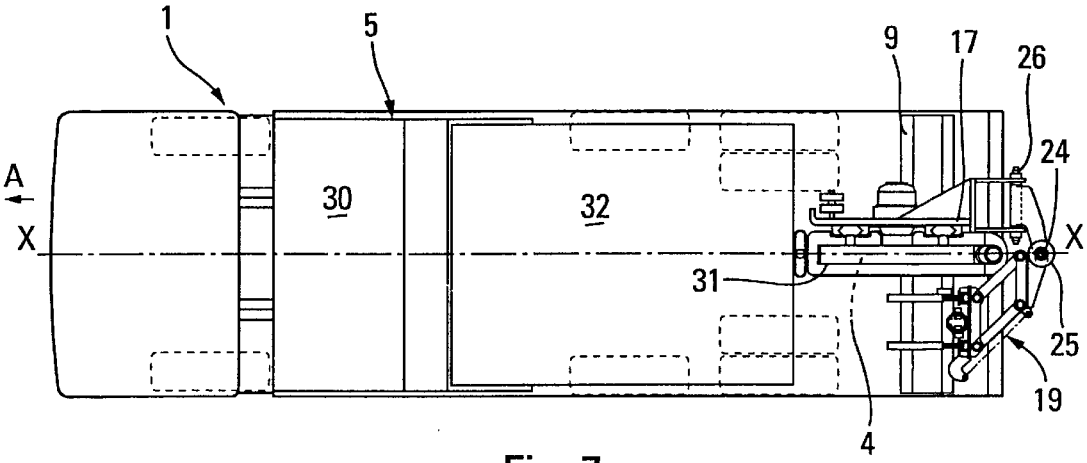
Fig. 7
Fig. 7B
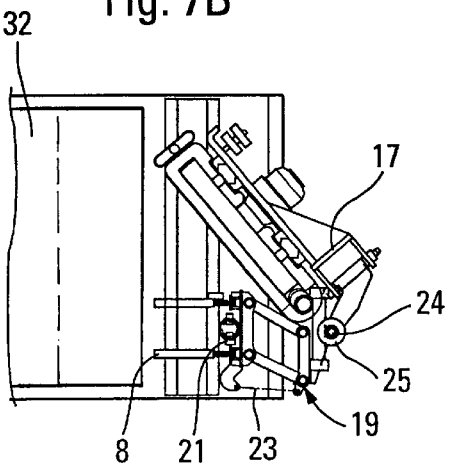
Fig. 7A
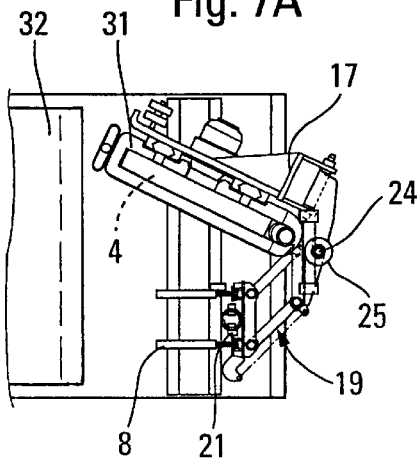

MOTORIZED ROAD-GOING VEHICLE FOR MAKING TRENCHES IN THE GROUND

FIELD OF THE INVENTION

The present invention relates to a motorized road-going vehicle for making trenches in the ground, allowing the subsequent laying of elongate objects such as, for example, optical and/or electric cables, pipe lines and/or ducts for fluids, etc.

BACKGROUND OF THE RELATED ART

In general, such a trench in the ground, which may be the pavement or the sidestrip of a road or the like, is made using a digging device with a trenching wheel carried by a special-purpose motorized vehicle which is very often outsized in terms of its width. As the trenching wheel rotates and the vehicle moves forward, a trench is obtained in the ground to the desired depth. In addition, in order to reduce the time that the work takes, because of the disruption it causes, another vehicle is used to suck up and collect the spoil produced during the digging of the trench as it exits the cutting face of the trenching wheel. This other vehicle may be coupled to the first and carry an appropriate device for sucking and collecting the spoil so that once this mechanised unit consisting of the two separate vehicles moving in convoy has passed, the pavement is in a clean state and the cables are ready to be laid in the trench thus produced.

Although the mechanised unit formed by these two motorized vehicles, with which the digging and sucking-up devices are respectively associated, yields good results as far as the trench obtained is concerned, it entails significant and expensive logistic planning and takes up a considerable amount of space on the road network. In addition, while such a mechanised unit, which may be as much as 25 to 30 meters long, is relatively operational on heavily used routes of the interstate, main road or major arteries through a town type, the same cannot be said when it comes to laying cables along secondary routes, where it is then necessary to completely interrupt the flow of traffic or at best set up alternating traffic flow to allow the mechanised unit to operate in complete safety. Further, in certain instances, the mechanised unit may even be unable to run along roads which are too narrow.

SUMMARY OF THE INVENTION

The object of the present invention is to overcome these drawbacks.

To this end, the motorized road-going vehicle for making trenches in the ground, of the type comprising, on its chassis, a device for digging trenches using a trenching wheel, which can be moved with respect to said chassis at least transversely to the longitudinal axis of said chassis and orthogonally with respect to the latter so as to position the trenching wheel in the ground, is notable, according to the invention, in that it additionally comprises, on its chassis, a device for sucking up and collecting the spoil produced while the trench is being dug, in association with the exit of the cutting face of the ditch produced by said trenching wheel, and in that said trenching wheel is carried by a frame which is mounted so that it can pivot, about a pivot pin orthogonal to the chassis, so that it occupies either a work position projecting with respect to said chassis so as to make said trench, or a transport position brought onto said chassis.

Thus, by virtue of the invention, one single same vehicle carries out the functions of digging the trench and sucking up and collecting the spoil, which makes it possible, under working conditions, to considerably reduce the disruption caused when carrying out works on the road network and also to reduce the logistics involved and therefore the cost of carrying it out. Further, in the transport condition, the vehicle can travel easily and legally because the frame carrying the trenching wheel falls inside the chassis. Thus, the vehicle can be used on the secondary road network. In addition, the self-contained nature of the vehicle according to the invention gives it great flexibility of use allowing it to make trenches at various points during the same day without needing excessive logistic planning.

In order to ensure good distribution of load across said vehicle, said sucking-up and collecting device is arranged at the central part of said chassis and said digging device is arranged at the rear part of the chassis. Advantageously, by the projecting working position of the trenching wheel with respect to the rear of the chassis, that is to say that it is overhanging, imposed by the pivot pin so that the trenching wheel can be switched from one position to the other, a spoil suction duct starting from said sucking-up and collecting device can then be led, at the exit of said cutting face, between the rear of the chassis and the trenching wheel.

Furthermore, said digging device is provided with an actuating member connecting said pivot pin to said frame of the trenching wheel so as to allow it to move from the work position to the transport position and vice versa. In a preferred embodiment, said actuating member is a rotary ram which rotates between 90° and 180° between the work position and the transport position.

In general, the digging device comprises a post mounted so that it can slide on transverse sideways associated with said chassis, and a carriage carrying said frame and able to slide vertically along said post.

Advantageously, provided between said carriage and the pivot pin is a connecting mechanism making it possible, under the action of a control member, to offset the frame of the trenching wheel transversely beyond a position in which said post is in abutment against the transverse ends of its slideways. For example, said connecting mechanism is of the deformable parallelogram type articulated, about pins orthogonal to the plane of said chassis and parallel to the pivot pin, to said carriage and to said pivot pin, an operating ram shifting the arms of the parallelogram mechanism.

In a preferred embodiment, said sucking-up and collecting device comprises:

- equipment for generating a depression, arranged on said chassis;
- a collecting vessel for the spoil produced, arranged on said chassis;
- a casing associated with the frame of said trenching wheel and enveloping its exterior part located outside the trench, said casing coming into contact with the ground to form, with said exterior part of the wheel, an internal space; and
- a duct connecting the outlet of said equipment to said casing so as to suck the spoil generated toward said vessel by pulling a depression in said internal space, using said equipment.

In addition, said sucking-up and collecting device can also comprise an auxiliary duct connected to one side of said casing and arranged, on the other side, to the rear of said wheel, in the bottom of the trench and/or on its lateral edges so as to suck up remaining spoil.

Advantageously, said depression equipment is a turbine and said spoil vessel is mounted so that it can tip on said chassis.

BRIEF DESCRIPTION OF THE DRAWINGS

The figures of the appended drawing will make it easy to understand how the invention may be achieved. In these figures, identical references denote similar elements.

FIGS. 6 and 7 depict the vehicle in a plan view and in a view from above, respectively, showing the trenching wheel of the digging device in the transport position.

FIGS. 7A and 7B are part views of the vehicle, showing the trenching wheel in two other transport positions.

DETAILED DESCRIPTION OF THE INVENTION

Figure 1:
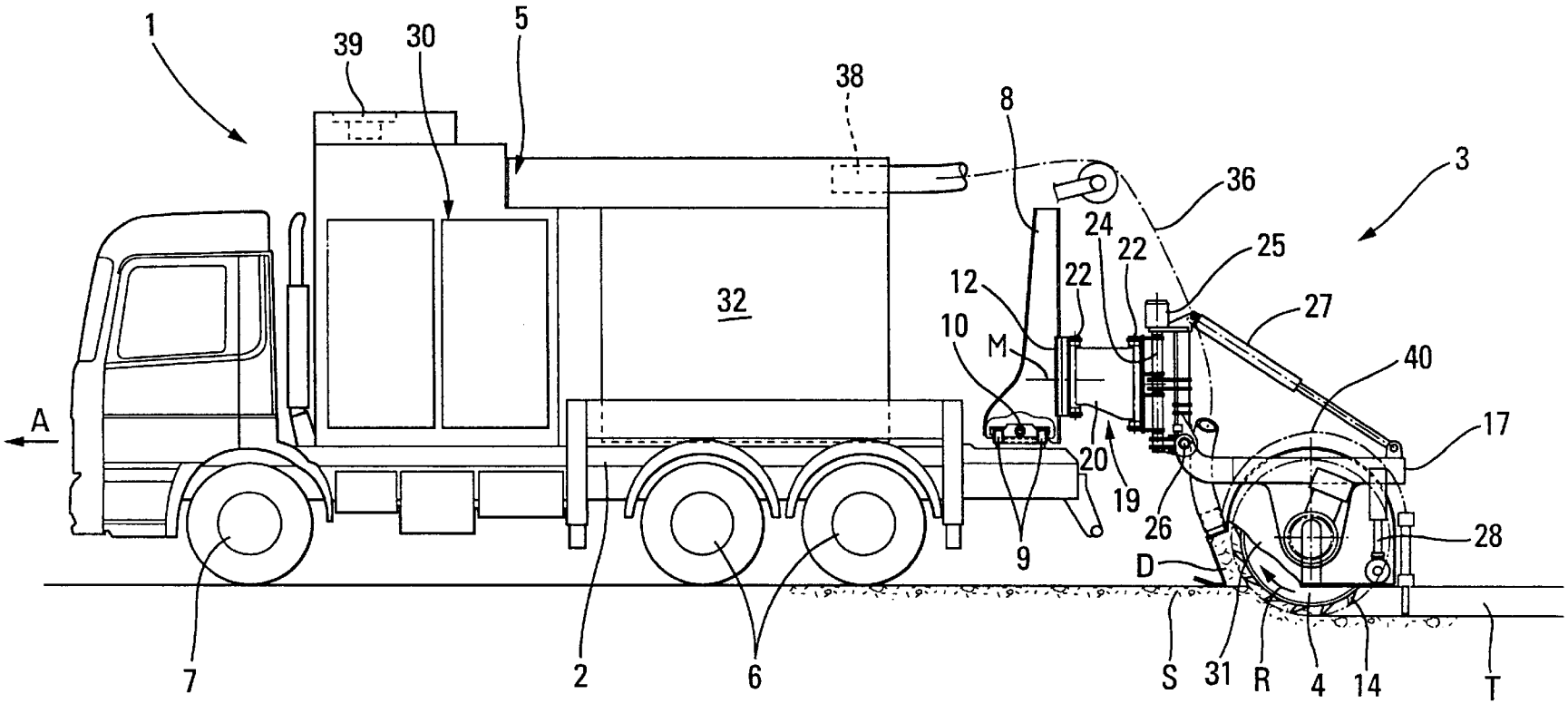
FIG. 1 is a plan view of one particular embodiment of the vehicle according to the invention, bearing the digging and sucking-up devices, while a trench is being made.
Figure 2:
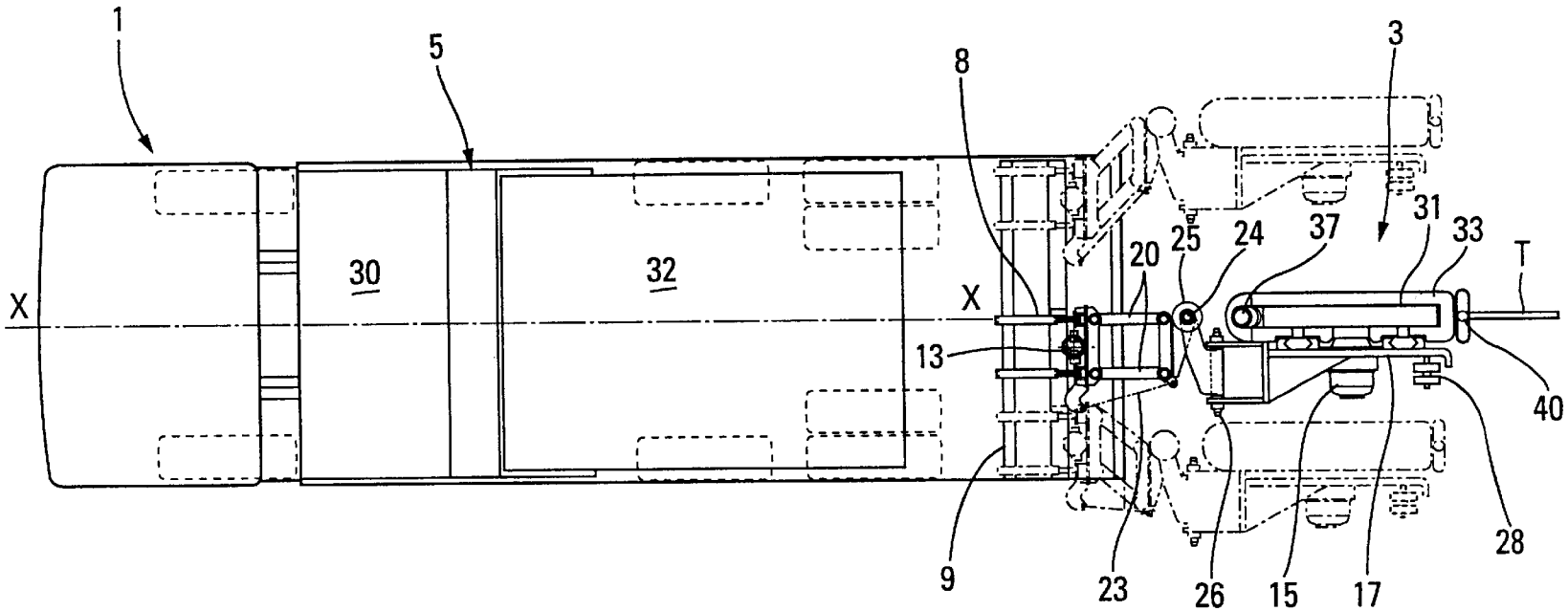
FIG. 2 is a view from above of the vehicle shown in FIG. 1.

According to the invention, the motorized vehicle 1 depicted in FIGS. 1 and 2 comprises, on its chassis 2, both a digging device 3 using a trenching wheel 4 for making a trench T in the ground S (for example a road) and a device 5 for sucking up and collecting the spoil D produced while the trench is being dug. In particular, the digging device 3 lies at the rear part of the chassis 2, to the rear of the double axial 6, and the sucking-up and collecting device 5 is arranged at the central part of the chassis, roughly between the front axle 7 and the double rear axle 6, this being so as to best distribute the loads over the chassis.

In the conventional way, the trenching wheel 4 (FIGS. 3 and 4) is equipped at its periphery with cutting members 14 (picks or teeth) attached fixedly or removably to the wheel disk. In the example illustrated, the wheel is intended to make narrow trenches (of the order of 5 to 10 cm wide) and of shallow depth (less than 40 cm), particularly for laying cables (optical, electrical, telephone, etc.). Any other type of trenching wheel such as cutting disks may of course be used depending on the desired application.

Structurally, the trenching wheel 4 is mounted on a rotating mechanism on rolling bearings 15, carried at it ends by the lateral flank 16 of a support frame 17 and driven in rotation by at least one drive member 18 such as a geared motor unit attached fixedly to the lateral flank 16.

Figure 3:
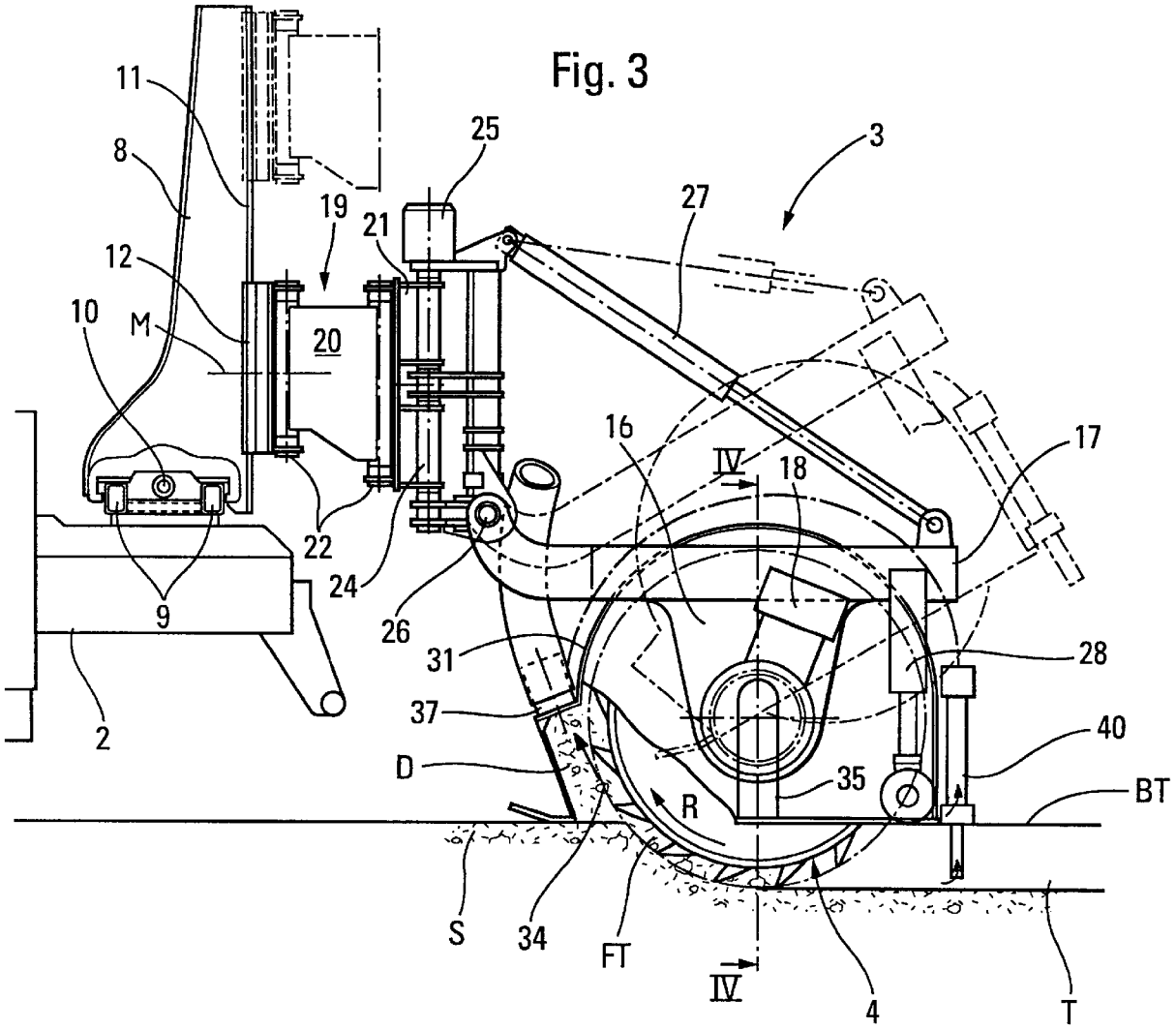
FIG. 3 shows, on a larger scale, the action of the digging and sucking-up devices.

More specifically, the digging device 3 shown in FIGS. 1 to 3 comprises a post 8 standing perpendicular to the plane of the chassis (that is to say vertically in FIGS. 1 and 3) and mounted so that it can slide on slideways 9 provided at the rear of the chassis and arranged transversely to the longitudinal axis X—X of the chassis 2 (FIG. 2). The device 3 may thus be moved along these slideways 9 via a drive member such as a ram 10. In addition, provided along the post 8 are vertical slideways 11 in which a carriage 12 is mounted so that it can slide via a ram 13 connecting the carriage to the post. Thus, the trenching wheel of the device can be shifted in a plane perpendicular to the chassis 2 to adjust, in particular, the depth of the trench that is to be made.

Provided between the carriage 12 and the frame 17 of the trenching wheel is a connecting mechanism 19 of the deformable-parallelogram type, which allows the trenching wheel 4, via its frame, to be offset beyond the width of the vehicle, as shown by the two embodiments depicted in chain line in FIG. 2. This, on the one hand, extends the possible transverse travel of the trenching wheel so that a trench can be made under certain specific particular conditions (for example near a sidewalk or a road side or in a sidestrip) and, on the other hand, frees the wheel as much as possible to allow it to move to the transport position as will be seen later.

More particularly, the connecting mechanism 19 comprises two parallel arms or plates 20 articulated to the carriage 12 and to an intermediate piece 21, about pins 22 which are mutually parallel and parallel to the vertical displacement of the carriage. To offset the trenching wheel 4 in one direction or the other, or into any other intermediate position, a ram 23 is provided, between the carriage 12 and the intermediate piece 21.

The latter is in turn connected to the frame 17 of the trenching wheel by a pivot pin 24 parallel to the pins 22 of the connecting mechanism 19 and therefore orthogonal to the horizontal plane of the chassis 2. An actuating member such as a rotary ram 25 associates the frame 17 with the pivot pin 24 so as to rotate the frame about the pin and thus allow the trenching wheel 4 to be moved from the work position to the transport position and vice versa, as will be seen later on. Because the frame 17 rotates about the pivot pin 24, the trenching wheel 4 is moved away from the chassis, so that it overhangs from the rear thereof, in its work position, this making it possible to bring in between the frame and the chassis a duct for sucking up the spoil directly as it leaves the cutting face as will be explained later on.

Furthermore, the frame 17 is, in the known way, of the type articulated about a pin 26 parallel to the rotating mechanism (horizontal axial of the wheel) so that, under the action of a ram 27 connecting the two articulated parts of the frame 17, the trenching wheel 4 can occupy a raised, up, position with respect to the ground S (as illustrated in chain line in FIG. 3) and a lowered position for gradually digging into the ground and making the trench.

The rear of the frame 17 may be equipped with stand legs 28 provided with rollers, which press against the ground near the trench, making it possible to support and to stabilize the digging device 3 on the ground.

A camber correcting mechanism, known per se, is also provided between the digging device and the chassis and is symbolized by an axis M parallel to the axis X—X and about which the frame of the trenching wheel can turn.

The sucking-up and collecting device 3 in this embodiment comprises equipment for generating a depression 30, such as a turbine, a casing 31 partially enveloping the trenching wheel 4 and connected to the turbine 30 and a collection skip or container 32 for collecting the sucked-up spoil. It can be seen in FIGS. 1 and 2 that the turbine and the skip are arranged on the chassis 2 of the motorized vehicle 1.

Figure 4:
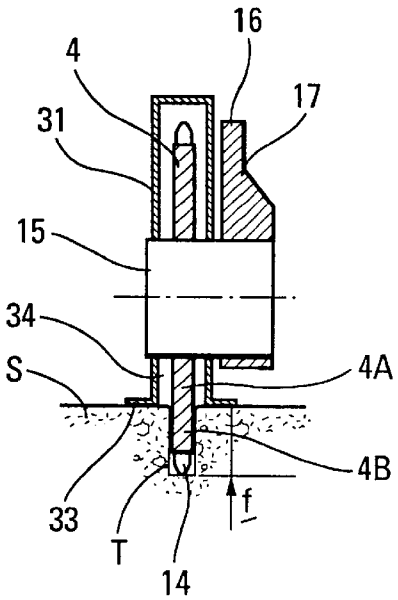
FIG. 4 is a cross section on IV—IV of FIG. 3.

More specifically, the casing 31 is connected to the frame 17 of the trenching wheel and envelops the outer part 4A of the wheel 4 lying outside the trench, as opposed to the inner part 4B which lies inside the trench at the same time. In structural terms, this casing 31 has a form which, in plan view, is semicircular, the cross section of which is in the form of inverted U, inside which the corresponding part of the wheel is arranged. The casing ends in a widened base or sole plate consisting of an external rim 33 which comes into contact with the surface of the ground S, as shown by FIGS. 1, 3 and 4. Thus, a relatively well-sealed space 34 is defined between the casing 31 and the enveloped corresponding part 4A of the trenching wheel. In addition, this casing 31 is mounted so that it can slide on the frame of the trenching wheel, parallel to its plane, so that it can be adjusted for height according to the depth of the trench that is to be made, corresponding to the arrow f of the part 4B of the wheel with respect to the casing. This height adjustment of the casing can be obtained by slideways 35 associating this casing with the flank of the frame and by a drive mechanism, not depicted, causing the casing to slide with respect to the flank.

In this embodiment, the turbine 30 communicates with the skip 32 for collecting the spoil and is connected to the internal space 34 between the casing and the wheel via a flexible duct 36. The latter is brought in between the trenching wheel and the rear of the chassis and is connected, on one side, to a suction capping 37 made in the casing, roughly at a tangent to the periphery of the wheel leaving the cutting face FT of the ditch and, on the other side, to an internal air-circulation passage 38 of the device 5, passing over the skip 32 and connected to the turbine 30 passing through series of filters, not depicted, to open out at 39 at the top of the vehicle 1.

The collection skip 32 is preferably mounted so that it is articulated on the chassis 2 so that it can be tipped sideways via rams, not illustrated.

In addition, connected in the region of the suction tapping 37 for example of the casing is one end of an auxiliary flexible pipe 40, the other end of which is brought into the rear of the casing 31 enveloping the cutting wheel 40 to suck up remaining spoil lying under the bottom of the trench T and along its external lateral edges BT, as indicated by the arrows in FIG. 3.

We shall now describe the way in which the motorized vehicle 1 and its associated devices 3 and 5 work.

It is first of all pointed out that the vehicle 1 with the cutting wheel of the digging device in the work position does not exceed 15 meters long, which considerably reduces the length of the mechanized unit used hitherto and in addition increases its maneuverability and driveability during digging.

The direction of travel of the vehicle 1 and the direction of rotation of the wheel 4 are indicated by arrows A and R respectively.

While the trench is being dug, the vehicle 1 is driven by a hydrostatic drivetrain also powering the various auxiliaries (rams, motors, etc.) and allowing its advance to be adapted easily to suit the digging of the trench.

It is assumed that the trench T is made with the trenching wheel 4 of the digging device 3 arranged along the central longitudinal axis X—X of the vehicle, at right angles to the plane of the chassis 2. Of course, the trenching wheel 4 could occupy any other transverse position by sliding the post 8 along the slideways 9 associated with the rear of the chassis and may even occupy a position of maximum offset for making its trench, depending on the working conditions.

Having adjusted the depth of the trench that is to be made by moving the casing 31 with respect to the wheel and moving the carriage 12 with respect to the post 8, and pivoting the articulated frame 17 about its pin 26, the trenching wheel 4, driven in rotation by the geared motor unit 18, bites into the ground S, until the rim 33 of the casing 31 touches the surface of the ground, so that a relatively sealed space 34 is created between the casing 31 and the corresponding part 4A of the wheel, outside the trench. This casing additionally constitutes effective protection for the operators. As the vehicle 1 is moved along via its hydrostatic drivetrain and as the wheel rotates, the cutting members 14 gradually dig the trench T (FIGS. 1 to 4). The spoil D produced by the ditch along the cutting face FT is carried to inside the casing, the internal space 34 of which is subject to a vacuum by virtue of the operation of the sucking-up and collecting device 5 and the "sealed" contact between the casing and the ground. As shown in greater detail in FIG. 3, the spoil D leaving the cutting face FT is then sucked up toward the flexible duct 36 and this sucking-up is optimized by the tangential arrangement of the suction tapping of the casing with respect to the wheel leaving the cutting face, and by the ejection of the spoil by the cutting members 14 themselves.

Thus, the vacuum created by the turbine 30 may be relatively weak but with a high suction rate, making it possible to use a box-shaped collecting skip with a higher capacity by comparison with a cylindrical container inside which a high vacuum can be pulled.

The sucked-up spoil D is collected, for the most part, in the collection skip 32 and the remaining fine particles are, for their part, trapped in the filtration systems of the device 5, so that clean air is expelled at the outlet 39.

Furthermore, the auxiliary flexible duct 40 allows the sucking-up of the spoil to be improved, particularly given that some of the material removed falls back onto the outer lateral edges BT of the trench T and in the bottom thereof as the wheel rotates.

All of the spoils produced is thus sucked up through the ducts 36 and 40 and collected in the skip 32 or the filters. It may be noted that they are collected in "closed" circuit (sealed casing, flexible ducts, skip, filters) which means that operation will be clean as far as the operators and the environment are concerned, something which is of particular benefit when digging trenches on the road network particularly in an urban environment.

When the trench T has been dug, the trenching wheel of the digging device 3 is advantageously brought up onto the chassis 2 so as to allow the vehicle 1 to travel without difficulty and legally on the road network.

To do that, the procedure may be as follows.

The ram 27 of the frame 17 is activated to its retracted position so that the articulated frame pivots about its pin 26. The trenching wheel 4 with its associated casing 31 tilts from its lowered working position to its raised position illustrated in chain line in FIG. 3. The carriage 12 of the device 3 carrying the frame of the wheel is then moved by the corresponding ram 13 to the raised position with respect to the post 8, and the latter is then moved by sliding in the transverse slideways 9 of the chassis 2 by its ram 10 until it reaches the end of its travel. The ram 23 of the deformable-parallelogram connecting mechanism 19 is then operated to offset the frame 17 of the wheel as far as possible with respect to the vehicle, as shown by its position in chain line in FIG. 2, for which the pivot pin is outside the width of the vehicle. The rotary ram 25 of the pivot pin 24 is then actuated, causing the frame 17 bearing the wheel 4 to rotate (FIG. 5).

Figure 5:
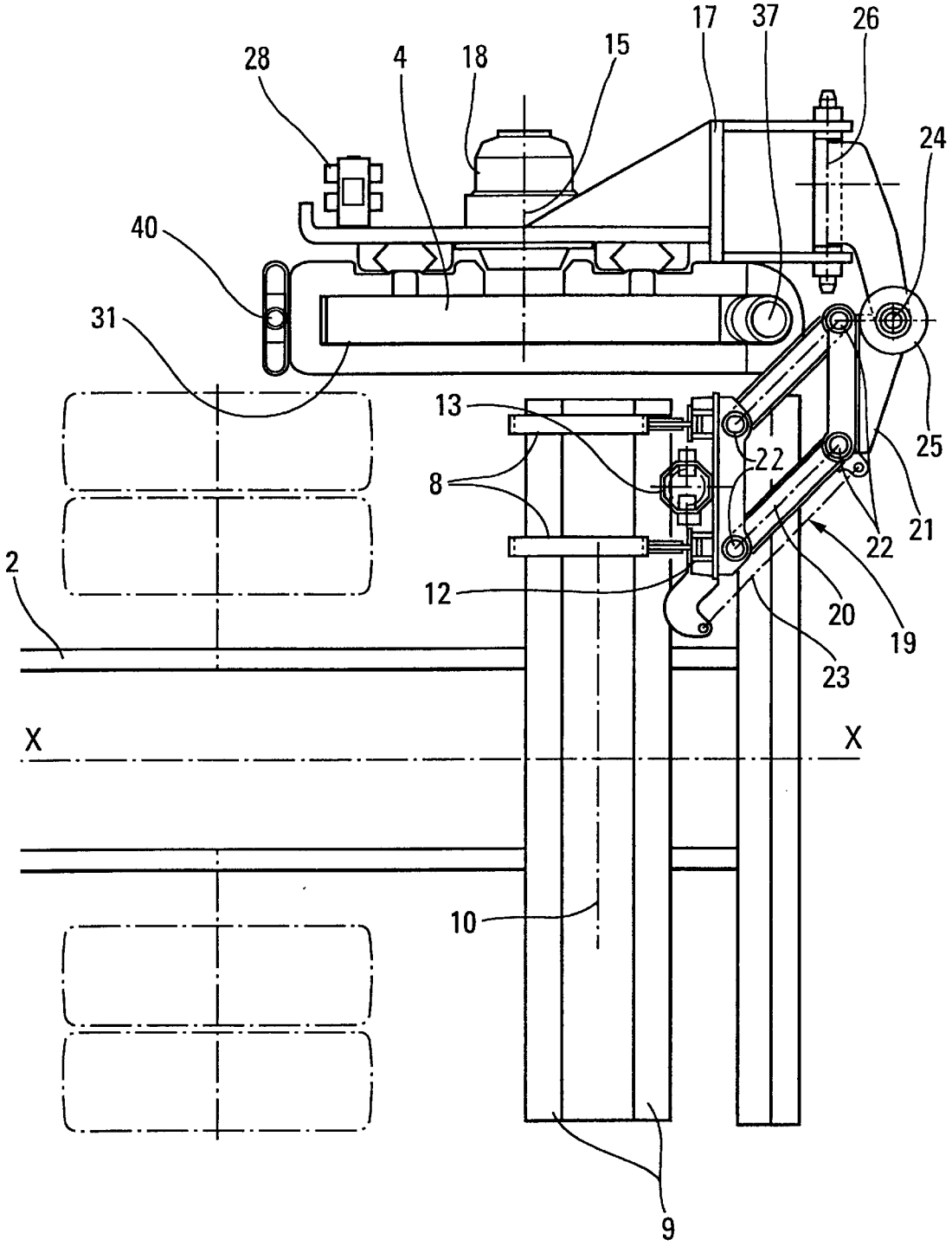
FIG. 5 depicts, in a view from above, a folded intermediate position of the trenching wheel before it is placed in the transport position on the vehicle.

In the example illustrated in FIGS. 5, 6 and 7, the frame 17 and its associated wheel 4 rotate about the pivot axis by 180° so that the plane of the wheel lies along the longitudinal axis X—X of the vehicle (orthogonal to the plane of the chassis) after the post 8 has been slid along the slideways 9 by the ram 10. The digging device 3 thus lies inside the chassis, without projecting therefrom, the wheel being in its transport position.

However, as shown respectively by FIGS. 7A and 7B, the rotation of the frame may differ, and for example be of the order of 150° or even of the order of 130°, by pivoting the deformable-parallelogram connecting mechanism 19 to the other side using the ram 23. The wheel 4 is then arranged at an angle with respect to the axis X—X of the chassis and occupies less space at the rear of the chassis while at the same time lying within its plane, which in particular makes it possible to fit a skip of larger capacity.

What is claimed is:

1. A motorized road-going vehicle for making trenches in the ground, comprising:

a chassis;

a device for digging trenches mounted on said chassis and having a frame carrying a trenching wheel, said trenching wheel being able to dig such a trench while said vehicle is moving;

first means to move said frame transversely to said chassis;

second means to move said frame vertically;

third means to rotate said frame about a vertical axis in such a way that said trenching wheel may occupy either a position projecting with respect to said chassis, or a position brought onto said chassis;

fourth means to rotate said frame about a horizontal axis in such a way that said trenching wheel may occupy either a raised-up position or a lowered Position; and mounted on said chassis, a device for sucking up and collecting spoil produced while the trench is being dug.

2. The vehicle as claimed in claim 1, wherein said sucking-up and collecting device is arranged at the central part of said chassis and said digging device is arranged at the rear part of the chassis.

3. The vehicle as claimed in claim 2, wherein a spoil suction duct starting from said sucking-up and collecting device leads at the exit of a cutting face, between the rear of the chassis and the trenching wheel arranged overhanging the rear of said chassis, in a work position.

4. The vehicle as claimed in claim 1, wherein said digging device is provided with an actuating member connecting a pivot pin to said frame of the trenching wheel so as to allow said trenching wheel to move from a work position to a transport position and vice versa.

5. The vehicle as claimed in claim 4, wherein said actuating member is a rotary ram which rotates between 90° and 180° between the work position and the transport position.

6. The vehicle as claimed in claim 1, wherein the digging device comprises a post mounted so that it can slide on transverse slideways associated with said chassis, and a carriage carrying said frame and able to slide vertically along said post, wherein, between said carriage and a pivot pin there is a connecting mechanism that makes it possible, under the action of a control member, to offset the frame of the trenching wheel transversely beyond a position in which said post is in abutment against the transverse ends of its slideways.

7. The vehicle as claimed in claim 6, wherein said connecting mechanism is a deformable parallelogram connecting mechanism articulated, about pins orthogonal to the plane of said chassis and parallel to the pivot pin, to said carriage and to said pivot pin, an operating ram shifting arms of the parallelogram mechanism.

8. The vehicle as claimed in claim 1, wherein said sucking-up and collecting device comprises:

equipment for generating a depression, arranged on said chassis;

a collecting vessel for the spoil produced, arranged on said chassis;

a casing associated with the frame of said trenching wheel and enveloping its exterior part located outside the trench, said casing coming into contact with the ground to form, with said exterior part of the wheel, an internal space; and a duct connecting an outlet of said equipment to said casing so as to suck the spoil generated toward said vessel by pulling a depression in said internal space, using said equipment.

9. The vehicle as claimed in claim 8, wherein said sucking-up and collecting device also comprises an auxiliary duct connected to one side of said casing and arranged, on the other side, to the rear of said wheel, in the bottom of the trench and/or on its lateral edges so as to suck up remaining spoil.

10. The vehicle as claimed in claim 8, wherein said depression equipment is a turbine and said vessel is mounted so that it can tip on said chassis.

* * * * *